US005277396A

United States Patent [19]

Vappula

[11] Patent Number: 5,277,396

[45] Date of Patent: Jan. 11, 1994

[54] CASTING MOULD

[75] Inventor: Kari Vappula, Toijala, Finland

[73] Assignee: Partek Concrete Oy Ab, Helsinki, Finland

[21] Appl. No.: 717,256

[22] Filed: Jun. 18, 1991

[30] Foreign Application Priority Data

Jun. 18, 1990 [FI] Finland ..... 903061

[51] Int. Cl.[5] ..... B28B 7/02

[52] U.S. Cl. ..... 249/65; 249/158; 249/163; 249/167

[58] Field of Search ..... 249/155, 158, 163, 165, 249/166, 167, 65, 137, 161; 425/182

[56] References Cited

U.S. PATENT DOCUMENTS

| | | | |
|---|---|---|---|
| 1,323,345 | 12/1919 | Wisner | 249/158 |
| 1,516,710 | 11/1924 | Caputo | 425/182 |
| 3,071,833 | 1/1963 | Tumey | 249/155 |
| 3,530,540 | 9/1970 | Mueller | 249/155 |
| 3,687,412 | 8/1972 | Vaughan et al. | 249/158 |
| 3,881,856 | 5/1975 | Fougea | 425/432 |
| 3,924,295 | 12/1975 | VerBurg | 425/182 |
| 4,634,359 | 1/1987 | Sartorio | 425/89 |
| 4,666,387 | 5/1987 | Yokota et al. | 425/182 |

FOREIGN PATENT DOCUMENTS

| | | |
|---|---|---|
| 1459229 | 5/1971 | Fed. Rep. of Germany . |
| 2128496 | 12/1971 | Fed. Rep. of Germany . |
| 2042151 | 3/1972 | Fed. Rep. of Germany . |
| 2907508 | 9/1980 | Fed. Rep. of Germany . |
| 304132 | 6/1971 | U.S.S.R. . |
| 476991 | 10/1975 | U.S.S.R. . |
| 700334 | 11/1979 | U.S.S.R. . |
| 2103143 | 2/1983 | United Kingdom . |

OTHER PUBLICATIONS

English abstract DE 2907508.
English abstract SU 476 991.
English abstract SU 700 334.
Betonwerk & Fertigteil-Technik, Heft 6/90, p. 123 (Advertisement with English text).

*Primary Examiner*—Jay H. Woo
*Assistant Examiner*—James P. Mackey
*Attorney, Agent, or Firm*—Burns, Doane, Swecker & Mathis

[57] ABSTRACT

A casting mold for casting concrete elements includes a bottom surface, two edge surfaces and two end surfaces. At least one of the edge surfaces is movable for positioning at a desired distance from the other edge surface. The movable edge surface is equipped with a transfer mechanism including a driver and at least one transfer arm and a connecting rod connecting to each transfer arm. The movable edge surface is fixed in place to the bottom surface by magnetic bolts.

15 Claims, 8 Drawing Sheets

A
12
14
5
3
13
16
2

CASTING MOULD

BACKGROUND AND SUMMARY OF THE INVENTION

This invention relates to a casting mould for casting concrete elements, in which mould there is a bottom surface, two edge surfaces and two end surfaces, whereby at least one edge surface can be moved and placed to desired distance from the other edge surface.

When casting wall elements of concrete a tipping mould equipped with edges is normally used as flush mould. A casting machine drives over a casting table and portions sealing compound in the mould. Under the table there are jogging devices for packing the sealing compound. After concreting has hardened, the table is tipped around a pivoted axle in the other edge almost to a vertical position, the mould edge thus getting up, i.e. the upper edge, is removed and the element is lifted off the table by links in its sides.

The position of the upper edge has to be able to be changed by size of the element to be casted. Today installation of a loose edge to a desired location is realized by keys or screws. Moving and installing the edge in this manner requires a lot handmade carpenter work.

The objective of this invention is to create a casting mould, the upper edge of which is easy to move and install to a desired location. Characteristic to the casting mould according to the invention is, that the movable edge surface is equipped with transfer elements connected to driving gear by transfer mechanism for transferring the edge surface. The movable upper edge is in the preferable embodiment of the invention equipped by bolts, which can be electrically magnetized, whereby the magnetic bolt is installed in its supporter in a manner, that it can be turned or slided in a manner, that the bolt can be transferred towards the bottom surface and away from the bottom surface, and on the upper side of the supporter of the movable edge surface, beneath a drawing element attached to the magnetic bolt, there is an intermediate element, with which the distance between the supporter of the movable edge surface and the drawing element can be changed.

Installation of the mechanically movable upper edge does not require handwork at all. Edge distance from the opposite edge can be adjusted fully steplessly. The magnetic bolts enable easy and quick installation of the edge, and when the magnetic bolts are fastened in a manner described above, also loosening of the bolts off the table surface is quick and easy to carry out.

BRIEF DESCRIPTION OF THE DRAWING FIGURES

The invention and its details will be described in more detail in the following referring to the accompanying drawings, wherein FIG. 1 is a top view of a casting mold according to the invention, FIG. 2 is a longitudinal section of an end of the mould shown in FIG. 1 in enlarged scale, FIG. 3 is a top view of a part of the end shown in FIG. 2, FIG. 4 is a top view of a further casting mould according to the invention, FIG. 5 is a cross profile B—B of the upper edge of the mould shown in FIG. 4 in enlarged scale, FIG. 6 is a cross profile of the bottom edge of the mould shown in FIG. 4, without side plate, FIG. 7 is a top view of a part of FIG. 4 in enlarged scale and FIG. 8 is a cross profile of a bolt used in the upper edge of the mould according to the invention.

DETAILED DESCRIPTION OF PREFERRED EMBODIMENTS

Figure 2:
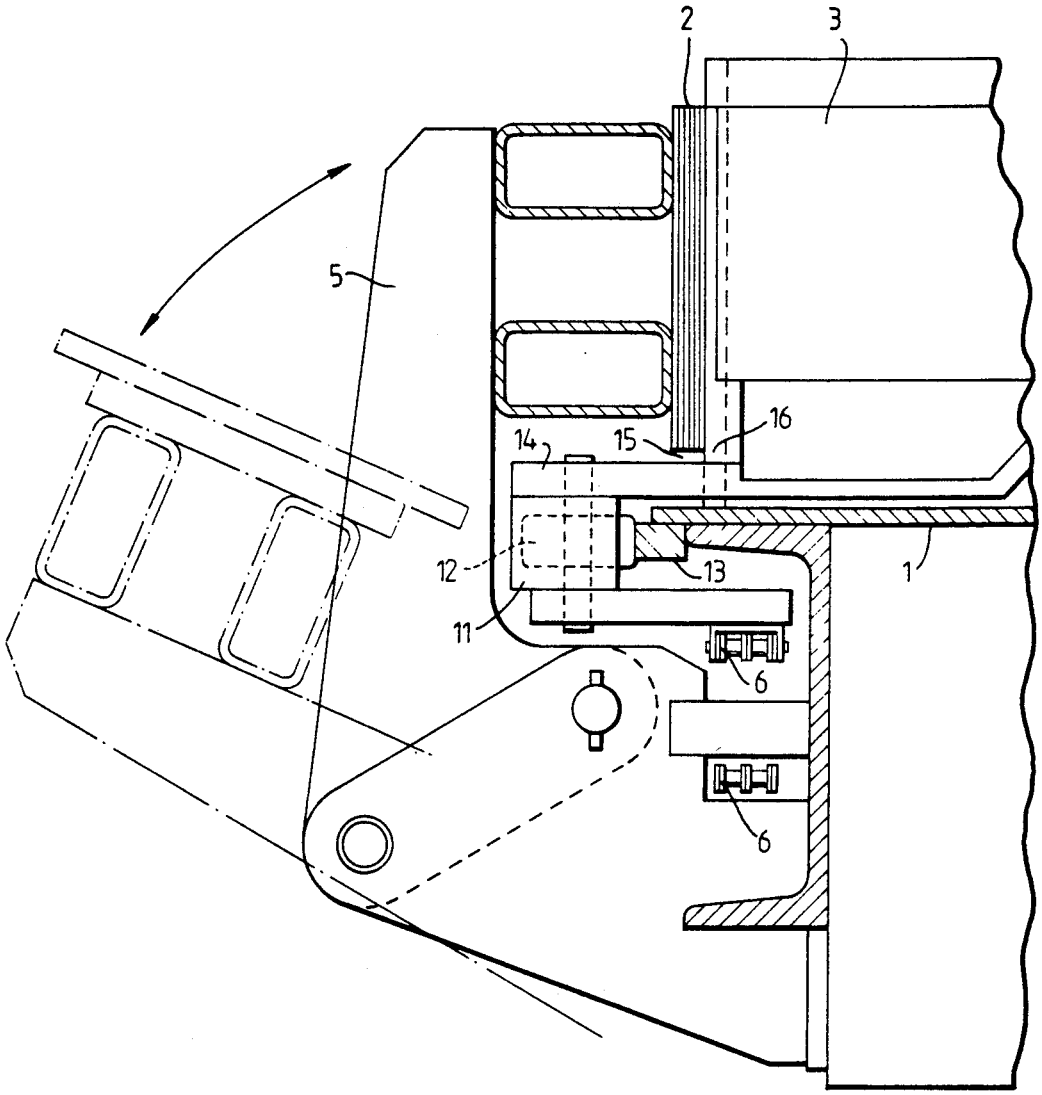

In the flush mould according to the invention there is a smooth steel surface 1 as base, ends 2, upper edge 3, which gets higher when turning the mould, and bottom edge 4, which gets lower. The ends 2 and the bottom edge 4 can be turned in a manner known per se when needed by an articulated arm 5 away from the element casted (position shown by dash line in FIG. 2).

Figure 1:
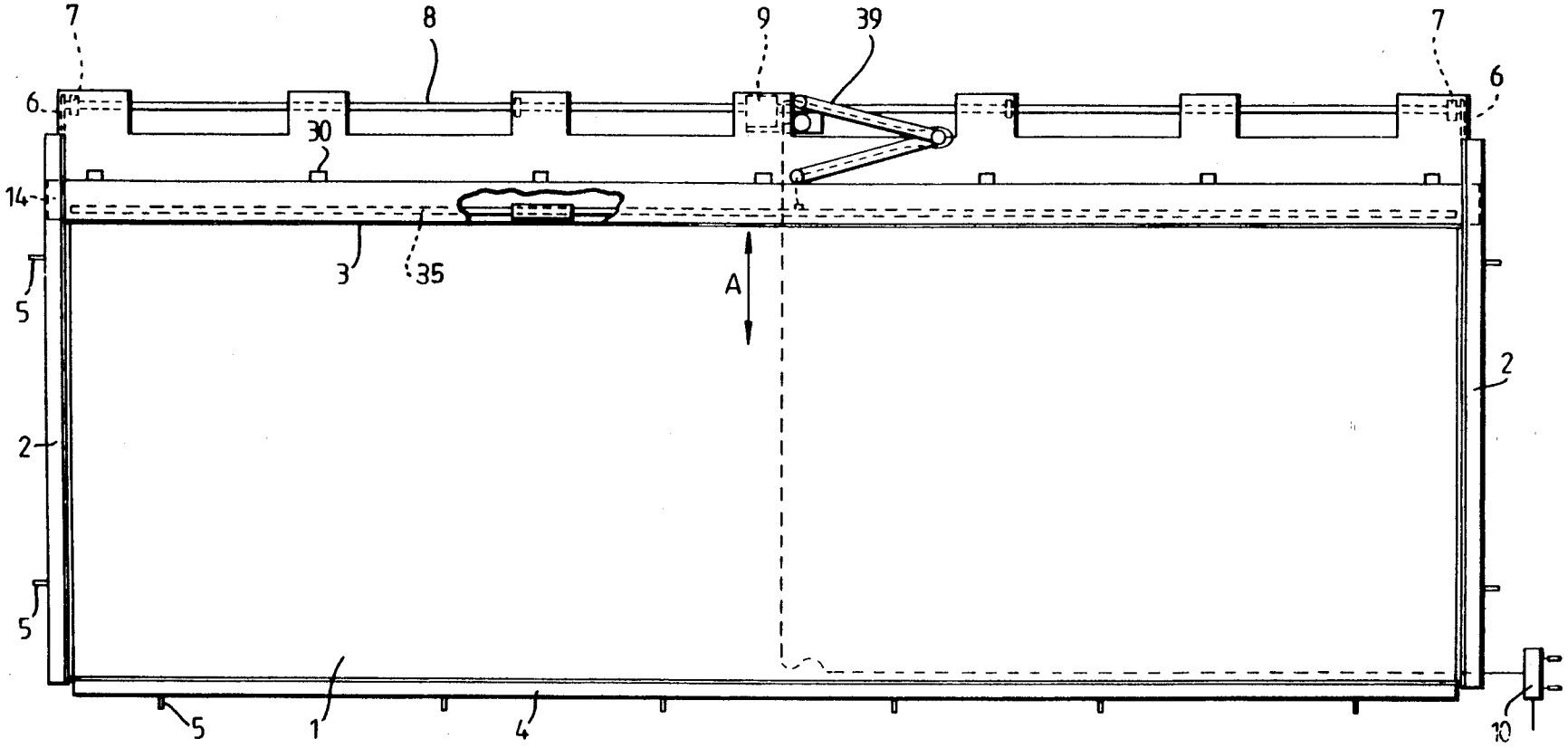
Figure 3:
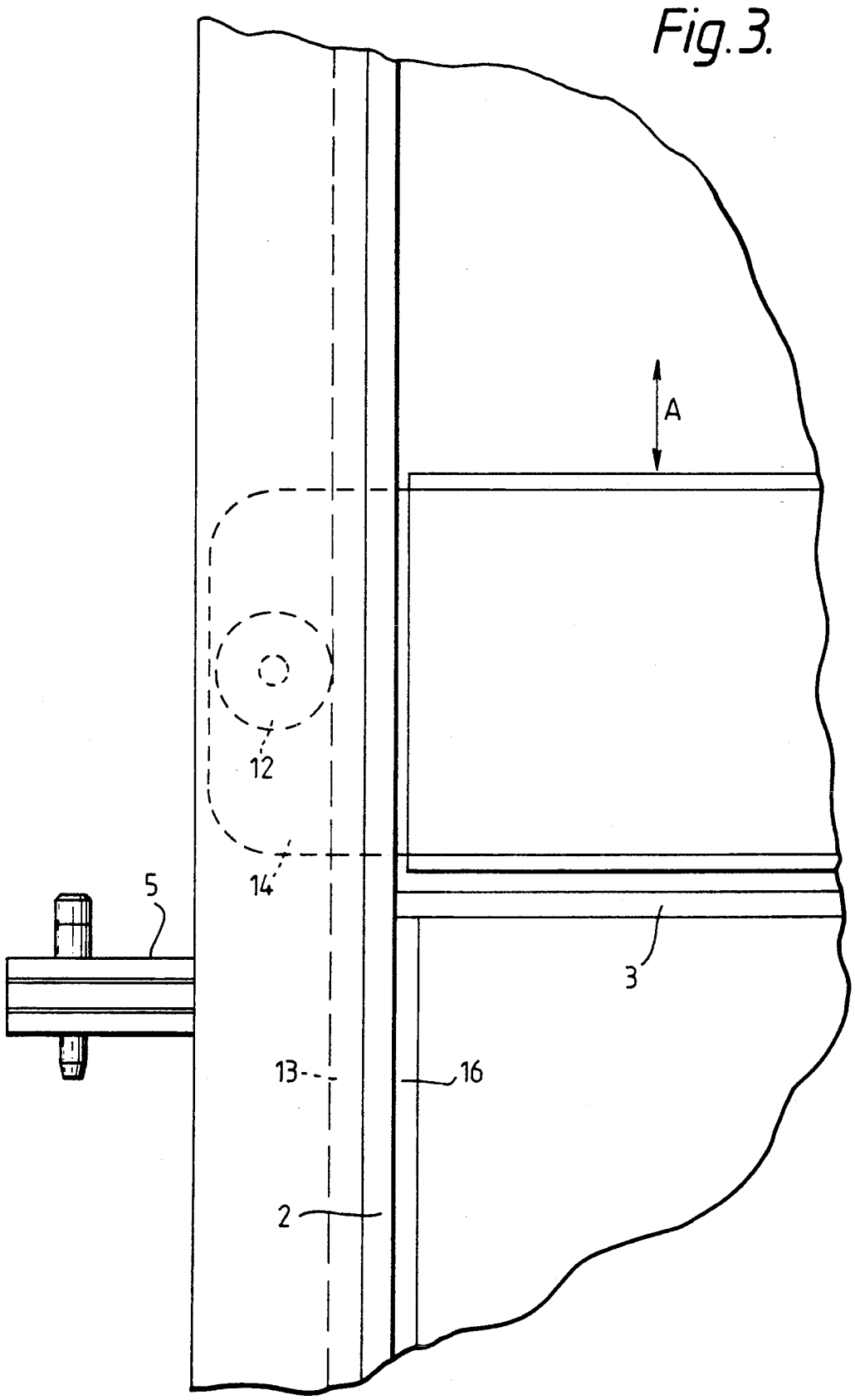

The upper edge 3 can be moved in a manner, that its distance from the bottom edge can be adjusted (arrow A). In the embodiments shown in FIGS. 1–3 the transfer is carried out by a transfer mechanism installed in the ends of the edge 3. In both ends of the mould, beneath the base surface 1 there is an endless chain 6 in cross direction to the mould. Both chains run around their own chain gear 7 and sheave. Chain gears 7 are located to the ends of a differential axle 8 extending over the whole length of the mould. The differential axle is run by a driving motor 9 equipped with change gear. Guiding the motor is carried out by operating panel 10.

In both endless chains 6 there is attached a transfer element 11, in which mounted in bearings a supporting roll 12 runs along a stock rail 13 in the end of the mold. The arm 14 of the transfer element 11 pushes its way through an opening 15 beneath the end 2 and its end is connected to the one end of the upper edge 3.

When rotating differential axle 8 by the motor 9, both chains 6 move their own transfer element 11 in stroke together and the upper edge 3 moves correspondingly either towards the bottom edge 4 or away from it. Before starting the casting a plywood strip 16 is attached to both ends 2, the length of which strip corresponds to the width of the element to be casted and which covers the opening 15. Then the upper edge is moved in its position by the transfer mechanism.

The upper edge 3 is equipped with magnetic bolts 30, the more close structure of which will be described later. A compressed-air hose needed for mechanism for loosening the bolts is identified by a reference number 35. A compressed-air supply lead 39 is attached in a folding pipe, whereby the articulated pipe settles in its position, when the edge 3 and the hose 38 is moved.

In FIGS. 4–7 there is shown another embodiment of the invention. It can be used for longer moulds, because more than two transfer elements in the ends can be used for moving the upper edge.

Figure 6:
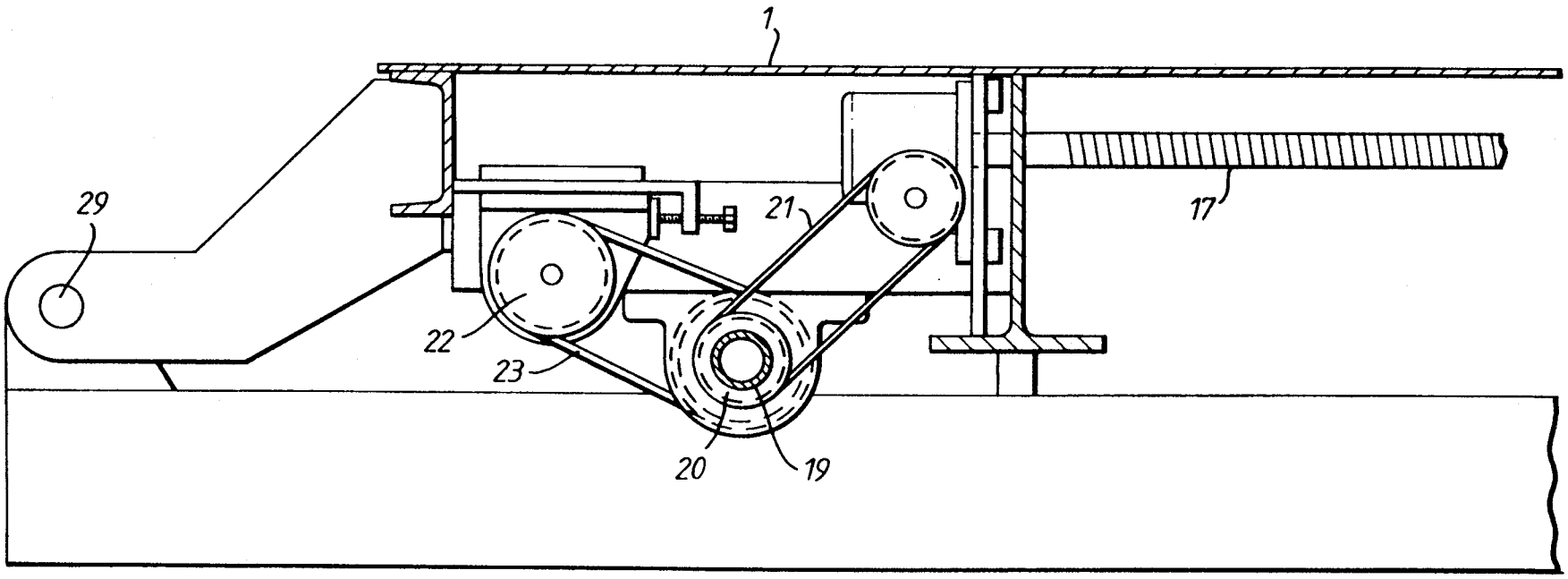
Figure 7:
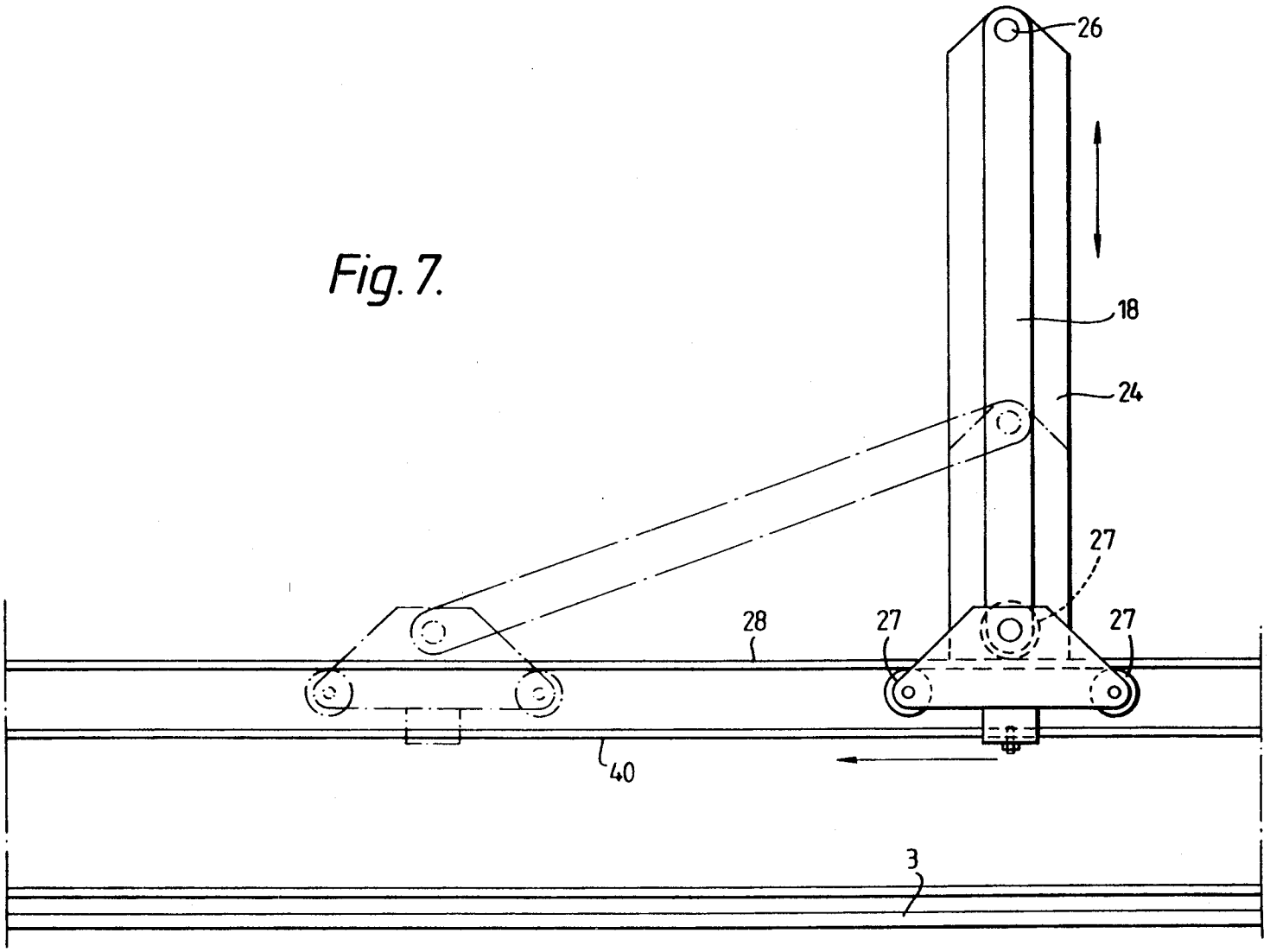

In a long mould screw jacks 17 are used as transfer mechanism. These are located beneath the base level 1 and attached to the outer surface of the upper edge 3 by connecting rods 18. Screws of the screw jacks 17 are rotated by drive gears 20 and cogged belts 21 attached to the differential axle 19 (FIG. 6). The differential axle 19 is rotated by the drive motor 22 and a cog belt 23. When rotating the screws 17 push their way into guide bars 24 equipped with inside threads or out from them. The guide bars are supported slidingly to the bottom surface 1 of the table by sliding sleeves 25.

The connecting rod 18 is in its one end connected to the outer end of the guide bar 24 by link 26. The other end of the connecting rod 18 is connected to a double T-rail 28 attached in the upper edge 3 by three supporting rolls 27. The supporting rolls 27 can roll in longitudinal direction in regard to the mould along a flange of the double T-rail 28.

When moving the edge 3 the connecting rods 18 are kept in parallel direction to the screws 17, whereby they direct push or pull force against the edge. After the edge has been locked in its position, the connecting rods 18 projecting sidewards can be directed away. This is carried out by a balance rope 40 and a pneumatic cylinder 41. A supporter 42 of the supporting rolls 27 is attached to the balance rope 40 running through two sheaves in longitudinal direction in regard to the table. The ends of the rope are fastened to the arms of the pneumatic cylinder containing two pistons. With the cylinder the rope and the supporters 42 along with it can be moved in longitudinal direction in regard to the table. When moving the supporter 42 sidewards, the guide bar of the screw jacks is simultaneously pulled under the table, whereby the connecting rod folds into a position shown by the dash line in FIG. 7.

Figure 4:
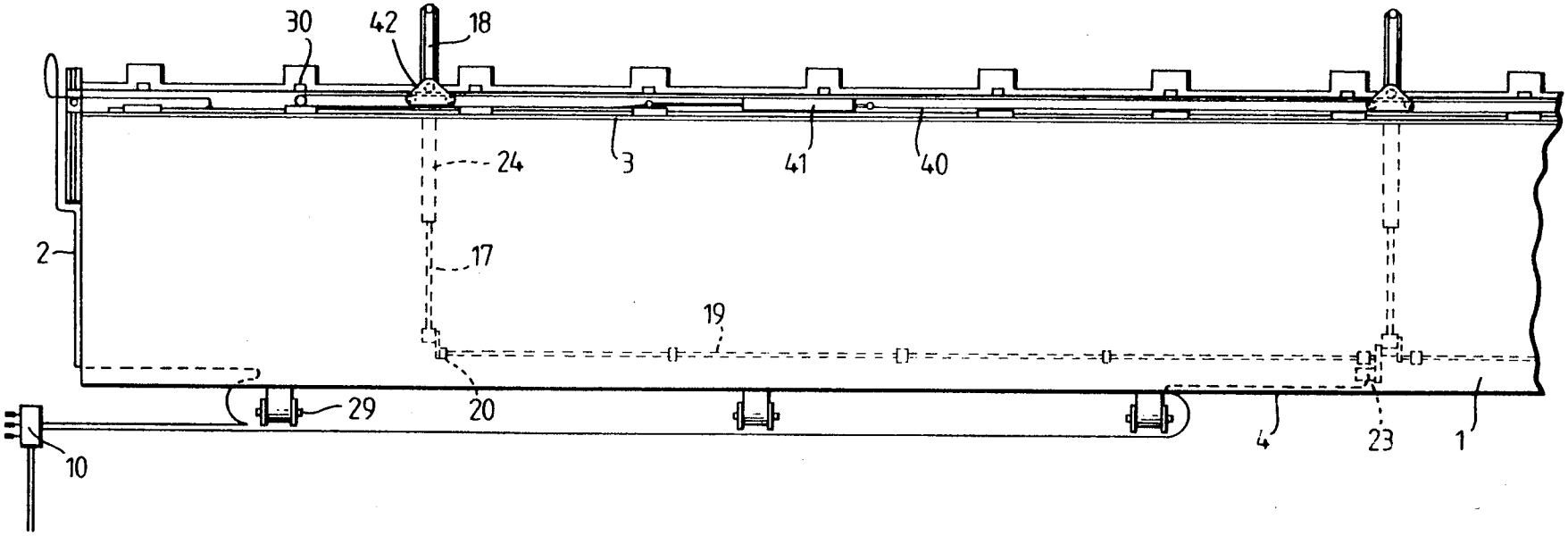
Figure 5:
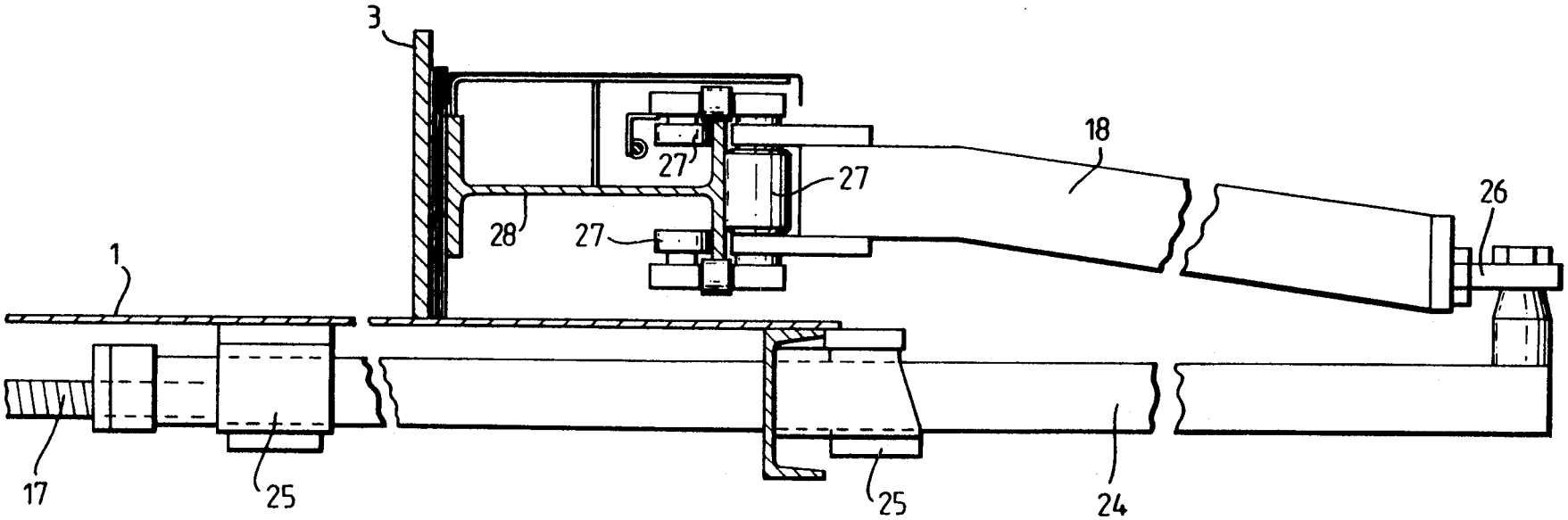

In FIGS. 4 and 6 there is also a tipping link 29 to be seen, around which the base level 1 can be inclined in a manner known per se, that the upper edge 3 is lifted upwards.

Figure 8:
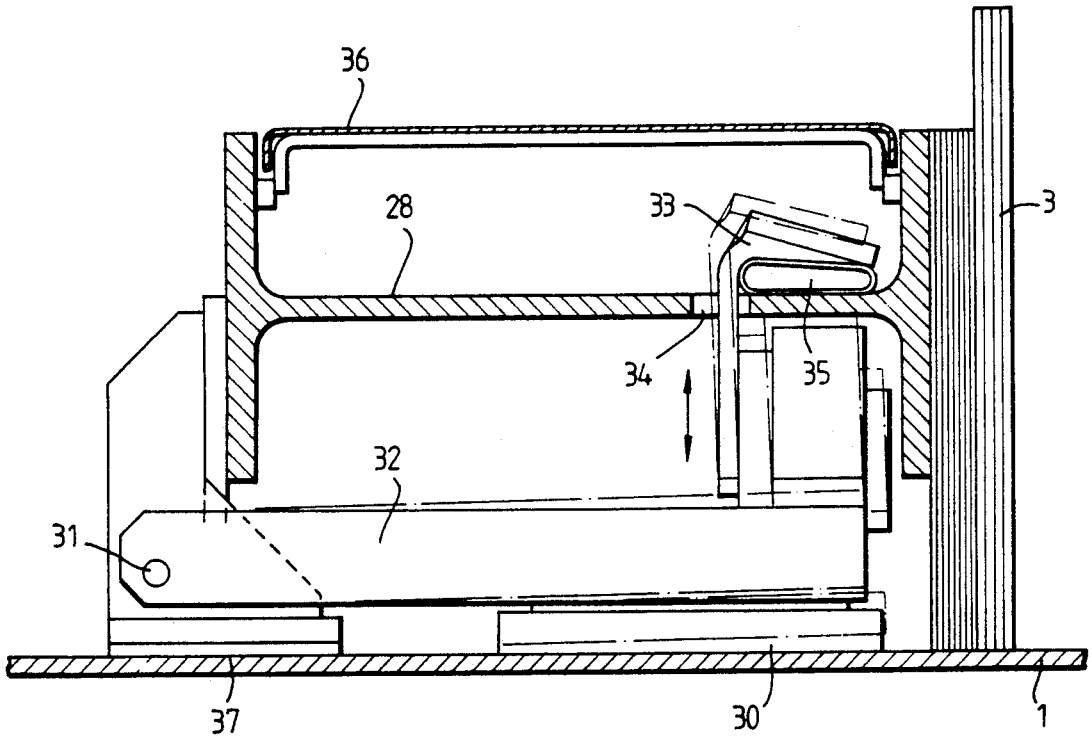

In the casting mould according to the invention the movable upper edge 3 can be locked in both embodiments described above in its position by the magnetic bolts 30 shown in FIG. 8. Using magnets as bolt is known per se and they are well adapted for locking against a smooth steel surface 1. In the following will be described a new solution for fastening and loosening the bolts.

In the supporting double T-rail 28 in the upper edge there is attached a swinging crank arm 32 through a link 31. In the outer edge of the crank arm 32 there is attached an electromagnet 30. Also in the crank arm 32 there is attached a draw hook 33, which extends upwards through an opening 34 in the double T-rail 28. The upper edge of the draw hook rests on the hose 35. In the side of the mould there are several bolts located in certain distance from each other. The hose goes in longitudinal direction in regard to the mould under all the draw hooks of the bolts over the double T-rail 28. A cover lid 36 covers the bolt.

When the electromagnet is magnetized by electric current, the bolt rests against the table surface 1 supported by a bearing surface and the magnet. Then compressed air is lead to the hose 35 in order to create clamping pressure (approx. 2 bar). The hose then distends and its upper surface presses against the bottom surface of the draw hook 33 directing the holding force of the magnet to the upper surface of the double T-rail and thus the bolt presses the edge plate 3 against the table surface 1.

When the edge plate 3 needs to be removed, the electric current is disconnected of the magnets 30. Magnetization does not, however, immediately discharge of the bolts. In order to loosen the magnets of the table 1, a higher loosening pressure (e.g. 6 bar) is lead to the hose 35. The hose then pushes the draw hook 33 upwards in force, which is higher than the aggregation force of the magnet, and the magnet 30 comes loose.

The invention is not limited only to the embodiments described above, but it can vary in different manners within the limits of the claims. The transfer movement of the upper edge can be created not only by chains or screws, but also by e.g. a hydraulic cylinder-piston-device.

In the magnet the hose 35 can be pressurized not only by gas but also by some hydraulic fluid. Instead of the hose also other expansive elements e.g separate pneumatic cushions or pneumatic cylinders can be used. Between the hook 33 and the rail 28 can also be located an eccentric turning around a horizontal axle, with which eccentric the distance between the hook and the rail can be changed. Instead of the turnable arm 32, a controlled lifting and lowering of the hook 33 can also be carried out by e.g. running rails.

What is claimed is:

1. A casting mold for casting concrete elements, comprising:

a bottom surface;

two end surfaces;

two edge surfaces, one of said edge surfaces being movable;

transfer means for moving the movable edge surface to a desired distance from the other edge surface;

the transfer means comprising:

driving means;

at least one transfer arm driven by the driving means, and located below the bottom surface; and, connecting means for connecting the transfer arm to an outer side of the movable edge surface for moving the movable edge surface.

2. The casting mold according to claim 1, wherein the connecting means includes at least one connecting rod attached to the outer side of the movable edge surface.

3. The casting mold according to claim 2, further comprising a pivotable joint connecting an outer end of the transfer arm extending beyond the bottom surface to an outer end of the connecting rod.

4. The casting mold according to claim 3, further comprising a rolling support member fixed to an inner end of each connecting rod, the rolling support member being movably attached to the outer side of the movable edge surface for movement along the movable edge surface.

5. The casting mold according to claim 4, further comprising means for selectively driving the rolling support member along the movable edge surface.

6. The casting mold according to claim 5, wherein the means for driving the rolling support member comprises an endless transmission and a motor for driving the endless transmission.

7. The casting mold according to claim 3, wherein the connecting rod is pivotable from an operating position parallel to the transfer arm to a position substantially parallel to the moveable edge surface.

8. The casting mold according to claim 1, further comprising:

a support member for supporting the movable edge surface;

at least one lifter, slidably carried in the support member for movement relative to the support member;

an electromagnet attached to each lifter;

the lifter having a lower position in which the electromagnet is in contact with the bottom surface and an upper position in which the electromagnet is out of contact with the bottom surface;

means for controlling the position of the lifter.

9. The casting mold according to claim 8, wherein the means for controlling the position of the lifter comprises a pressure expandable means.

10. The casting mold according to claim 9, wherein the pressure expandable means comprises an expandable hose carried in the support member and arranged in relation with the lifter so that expansion of the hose urges the lifter to the upper position and provides an opposing force to the support member.

11. The casting mold according to claim 10, wherein the lifter has an upper edge and the lifter is arranged in the support member so that the upper edge is in contact with the pressure expandable means.

12. The casting mold according to claim 11, wherein the upper edge of the lifter is in contact with an upper side of the expandable means so that expansion of the expandable means raises the lifter.

13. A casting mold for casting concrete elements, comprising:

a bottom surface;

two end surfaces;

two edge surfaces, at least one of said edge surfaces being movable;

transfer means for moving the movable edge surface to a desired distance from the other edge surface;

said transfer means comprising:

a driving mechanism mounted beneath the bottom surface;

at least one guide bar slidably supported beneath the bottom surface and having an outer end extending beyond the bottom surface, the guide bar coupled to the driving mechanism for driving the guide bar; and, a connecting rod pivotally connected at an outer end to the outer end of the guide bar and connected at an inner end to the movable edge surface.

14. The casting mold as claimed in claim 13, wherein the driving mechanism comprises a rotatable screw jack engaging threads of the guide bar.

15. The casting mold as claimed in claim 13, wherein the connecting rod is slidably connected to the movable edge surface by a rolling member.

* * * * *